United States Patent [19]

Stahl et al.

[11] 4,421,516

[45] Dec. 20, 1983

[54] PROCESS FOR PREPARING DISCHARGE RESIST PRINTS ON HYDROPHOBIC TEXTILE MATERIALS

[75] Inventors: Theo Stahl, Frankfurt am Main; Ulrich Bühler, Schöneck, both of Fed. Rep. of Germany

[73] Assignee: Cassella Aktiengesellschaft, Frankfurt am Main, Fed. Rep. of Germany

[21] Appl. No.: 473,783

[22] Filed: Mar. 10, 1983

[30] Foreign Application Priority Data

Mar. 15, 1982 [DE] Fed. Rep. of Germany ..... 3209327

[51] Int. Cl.[3] ..... D06P 5/15

[52] U.S. Cl. ..... 8/464; 8/456; 8/588; 8/589; 8/591; 8/594; 8/921; 8/922

[58] Field of Search ..... 8/464, 456

[56] References Cited

U.S. PATENT DOCUMENTS

| | | | |
|---|---|---|---|
| 2,322,322 | 6/1943 | Seymour et al. | 8/464 |
| 2,322,323 | 6/1943 | Seymour et al. | 8/464 |
| 3,972,677 | 8/1976 | Feess et al. | 8/464 |
| 4,313,731 | 2/1982 | Imahori | 8/451 |
| 4,349,348 | 9/1982 | Tappe et al. | 8/464 |
| 4,386,935 | 6/1983 | Buhler et al. | 8/451 |

*Primary Examiner*—A. Lionel Clingman

*Attorney, Agent, or Firm*—Connolly and Hutz

[57] ABSTRACT

An improved process for preparing discharge prints on textile materials containing hydrophobic fibers wherein at least one disperse dyestuff dischargeable to white is applied to the textile material in the form of a dyeing liquor of print paste and also contacted by a pattern-applied discharge resist print paste, and then the material is heat treated at 100° to 230° C. wherein the improvement comprises said discharge resist print paste having, under the heat treatment conditions, a pH value of zero to 3.

16 Claims, No Drawings

PROCESS FOR PREPARING DISCHARGE RESIST PRINTS ON HYDROPHOBIC TEXTILE MATERIALS

The present invention relates to a process for preparing discharge resist prints on textile materials which consist of hydrophobic fibres or predominantly contain hydrophobic fibres, in which one or more disperse dyestuffs dischargeable to white and, if appropriate, one or more non-dischargeable disperse dyestuffs are applied to the textile material in the form of a dyeing liquor or print paste and then carefully dried incipiently or completely, and a discharge resist print paste, which can, if desired, also contain one or more non-dischargeable disperse dyestuffs, is then printed on in the desired pattern, but the order in which the discharge resist print paste and the print paste are printed can also be reversed and if a print paste is used the incipient drying or intermediate drying can also be dispensed with, and then a heat treatment at 100° to 230° C.

In textile printing it has always been difficult to generate sharp patterns, be they white or coloured, on a deeply coloured background. The direct printing of textile material is a complete failure in particular in preparing filigree-like patterns on a dark ground. To prepare such patterns it is known to print a discharge print paste in the desired pattern onto a deep background dyeing prepared with a dyestuff dischargeable to white, and then to destroy the dyestuff in the areas printed with the discharge print paste, by means of a dry or wet heat treatment. The prints thus obtained are washed out, giving the desired pattern white on dark ground. It is also already known to add to discharge print pastes dyestuffs which are resistant to the discharging agent. In this case, the textile material is dyed by the indestructable dyestuff, in the printed areas, at the same time as the ground dyeing is being destroyed. In this case, coloured prints are obtained on dark ground. Coloured prints on dark ground can also be obtained when the dark ground is prepared with a mixture of a dischargeable dyestuff and of a non-dischargeable dyestuff of different colour.

Applying these known methods to textile materials which consist of hydrophobic synthetic fibres is difficult to the extent that discharging, for example, polyester fibres dyed with disperse dyestuffs is very difficult. Once disperse dyestuffs are fixed, that is dissolved, in the polyester fibre, they are largely inaccessible to aqueous agents and hence also to aqueous discharge print pastes. In preparing discharge prints on textile materials containing hydrophobic fibres or consisting of hydrophobic fibres, the known discharge printing method is therefore modified in that the textile material is first padded with a dyeing liquor containing disperse dyestuff and then completely or incipiently dried so carefully that the dyestuff is not fixed, that is is not dissolved, in the hydrophobic fibre. The dried or incipiently dried padded fabric is then printed with the discharge print paste in the desired pattern, and the fabric thus treated is then subjected to a heat treatment, during which the ground dyestuff migrates into, that is is fixed in, the polyester in the unprinted areas, and the dyestuff is destroyed, that is dyeing does not take place, in the areas printed with discharge print paste. This method is also referred to as discharge resist printing.

The inherently simple method of discharge resist printing harbours a number of technical problems, which in many cases make its use difficult. For instance, it is as a rule not simple to destroy the ground dyestuff by means of the discharging agent without leaving a residue. If this is not accomplished, a coloured residue remains behind on the discharged areas, its shade varying between yellowish brown and dull violet or reddish grey shades and which stains the white ground in the discharged areas. This leads to white discharges which appear dirty, or, in the case where coloured discharges are to be prepared, to a distortion of the shade of the dyestuff which is resistant to the discharging agent.

To overcome this problem, discharge printing pastes are used which contain relatively strong reducing or oxidising agents, such as, for example, alkali metal formaldehydesulphoxylates, or even heavy metal salts, such as, for example, tin(II) chloride. It is true that it is as a rule possible, by means of such strong discharging agents, to obtain an acceptable white discharge print, but frequently the fibre material is damaged. Also, these discharging agents are as a rule not cheap.

To overcome these problems, the background dyeing requires disperse dyestuffs which can be discharged to a pure white by means of very mild agents. German Offenlegungsschriften Nos. 2,612,740, 2,612,741, 2,612,742, 2,612,790, 2,612,791, 2,612,792, 2,836,391, 3,021,269 and 3,035,912 disclose dyestuffs which can be discharged by aqueous alkalis, either their chromophor being destroyed or their carboxylate or sulphonamide groups being converted into a salt-like structure, whereby the dyestuffs are rid of their affinity for the fibre. The use of such dyestuffs in the method described leads on polyesters through hydrolysis to fibre damage, which is unacceptable in particular in the case of very light-weight, thin types of fabric. In addition, such dyestuffs can as a rule be prepared only by means of special, expensive methods, starting from precursors specifically produced for this dyestuff type. However, on top of all this they also exhibit deficiencies on application. For instance, after the discharge they have certain affinity for hydrophilic accompanying fabrics, staining these, or they tend to thermomigrate, or they have poor affinity and hence only a low colour yield on the fibre. Their special structure also usually has an adverse effect on the end-use fastness properties, such as, for example, the light fastness and the fastness to heat-setting.

It has now been found, surprisingly, that even conventional disperse dyestuffs, for example of the azo or naphthalimide or anthraquinone series, are suitable for use as dyestuffs dischargeable to white in the discharge resist printing of hydrophobic textile materials when, in the process described at the outset, a discharge resist print paste is used which has a pH value of equal to or less than 3, preferably equal to or less than 2, very particularly preferably equal to or less than 0.8, during the heat treatment at 100° to 230° C. Suitable for this purpose are discharge resist print pastes which have the above-mentioned pH values even at room temperature or in which the pH values specified are brought about under the application conditions by elimination of acids or of materials having an acidic reaction. Accordingly, the acid pH value required of the acidic discharge resist print paste used according to the invention is suitably brought about by means of acids or acid-reacting materials having a corresponding low pKa value or of compounds which split off acids or acid-reacting materials in the discharge resist pastes only under application conditions. Examples of materials suitable for adjusting the pH are aliphatic or aromatic sulphonic or sulphinic acids, aliphatic or aromatic carboxylic acids, aliphatic or aromatic phosphoric or phosphinic acids or monophosphonates, mineral acids, aliphatic, aromatic or aliphatic/aromatic disulphimides, N-acylsulphonamides or N-acylamidosulphonates, ammonium salts of sulphonic acids, alkali metal salts of sulphonic acids in conjunction with mineral acids or organic or inorganic compounds which under thermal or hydrolytic action during the process according to the invention liberate one of the abovementioned acids.

Examples of suitable sulphonic and sulphinic acids can be selected from among arenemonosulphonic, arenedisulphonic, arenemonolsulphinic or arenedisulphinic acids, alkanesulphonic or alkanesulphinic acids having 1 to 5 C atoms, alkenesulphonic or alkenesulphinic acids having 2 to 5 C atoms, cycloalkanesulphonic or cycloalkanesulphinic acids having 5 to 7 C atoms, or N-, O- or S-containing five- or six-membered heterocyclic sulphonic acids. These sulphonic and sulphinic acids can be optionally monosubstituted or polysubstituted, in the case of multiple substitution by identical or different substituents. Examples of suitable substituents are alkyl or alkoxy having 1 to 8 C atoms each, alkenyl having 3 to 5 C atoms, alkylcarbonyl having a total of up to 8 C atoms, optionally substituted phenylcarbonyl, optionally substituted aminocarbonyl, alkoxycarbonyl having a total of up to 9 C atoms, phenoxycarbonyl, cyano, nitro, fluorine, chlorine, bromine, hydroxycarbonyl, aminosulphonyl, alkylsulphonyl having up to 8 C atoms, optionally substituted phenylsulphonyl, alkylsulphinyl having up to 8 C atoms, optionally substituted phenylsulphinyl, phenyl, hydroxyl or acetamino, and thiocyano. Examples of suitable sulphonic acids are: benzenesulphonic acid, 2-, 3- or 4-methylbenzenesulphonic acid, 2,5-, 3,4- or 2,4-dimethylbenzenesulphonic acid, 2,4,5-trimethylbenzenesulphonic acid, 4-ethylbenzenesulphonic, 4-n-propylbenzenesulphonic, 4-i-propylbenzenesulphonic, 4-n-butylbenzenesulphonic, 4-isobutylbenzenesulphonic, 4-sec.-butylbenzenesulphonic or 4-tert.-butylbenzenesulphonic acid, 4-fluorobenzenesulphonic acid, 4-chlorobenzenesulphonic acid, 2,5- or 3,4-dichlorobenzenesulphonic acid, 2,4,5-trichlorobenzenesulphonic acid, 4-bromobenzenesulphonic acid, 2-, 3- or 4-cyanobenzenesulphonic acid, 2-, 3- or 4-nitrobenzenesulphonic acid, 3,5-dinitrobenzenesulphonic acid, 4-methoxybenzenesulphonic, 4-ethoxybenzenesulphonic or 4-isopropoxybenzenesulphonic acid, 3-chloro-4-methylbenzenesulphonic acid, 5-chloro-2-methylbenzenesulphonic acid, 4-chloro-2,5-dimethylbenzenesulphonic acid, 5-chloro-2,4-dimethylbenzenesulphonic acid, 4-methyl-3-nitrobenzenesulphonic acid, 2-methyl-5-nitrobenzenesulphonic acid, 4-chloro-3,5-dinitrobenzenesulphonic acid, 4-methyl-3,5-dinitrobenzenesulphonic acid, 2-methyl-3,5-dinitrobenzenesulphonic acid, 2,4-dimethyl-3,5-dinitrobenzenesulphonic acid, 2,4-dimethyl-3,5,6-trichlorobenzenesulphonic acid, naphthalene-1- and -2-sulphonic acid, 1-methylnaphthalene-3-, -5- or -6-sulphonic acid, 1-n-butylnaphthalene-2-sulphonic acid, 1-benzylnaphthalene-4-sulphonic acid, 1-phenylnaphthalene-8-sulphonic acid, 1,4-dimethylnaphthalene-6-sulphonic acid, 1,5-dimethylnaphthalene-3- or -4-sulphonic acid, 1,6-dimethylnaphthalene-3- or -5-sulphonic acid, 2,3-dimethylnaphthalene-5- or -6-sulphonic acid, 1,4-diethylnaphthalene-6-sulphonic acid, 1,4-diisopropylnaphthalene-6-sulphonic acid, 1,6-diisopropylnaphthalene-3- or -7-sulphonic-acid, 1,6-diisobutylnaphthalene-3- or -7-sulphonic acid, 1,4-di-n-butylnaphthalene-6-sulphonic acid, 2,3-di-tert.-butylnaphthalene-5- or -6-sulphonic acid, 1-methyl-4-n-hexylnaphthalene-6-sulphonic acid, 1-chloronaphthalene-4-, -5- or -8-sulphonic acid, 1-nitronaphthalene-5- or -8-sulphonic acid, 1,4-dicyanonaphthalene-5-sulphonic acid, naphthalene-1,5-, -1,6-, -2,6- or 2,7-disulphonic acid, benzene-1,3-disulphonic acid, tetrahydronaphthalene-1- and -2-sulphonic acid, diphenylsulphonic acid, methanesulphonic acid, ethanesulphonic acid, n-propanesulphonic acid, n-propenesulphonic acid, n-butanesulphonic acid, i-butanesulphonic acid, n-hexanesulphonic acid, n-octanesulphonic acid, i-octanesulphonic acid, n-dodecanesulphonic acid, chloromethanesulphonic acid, trichloromethanesulphonic acid, 2-chloroethanesulphonic acid, 2-hydroxyethanesulphonic acid, 4-hydroxybutanesulphonic acid, 3-chloro-2-hydroxypropanesulphonic acid, 2-ethoxyethanesulphonic acid, perfluorooctanesulphonic acid, hydroxycarbonylmethanesulphonic acid, methallylsulphonic acid, sulphopalmitic acid, and cyclohexanesulphonic acid. Also suitable are: polysulphonic acids of the type which can be prepared so as to have between 5 and 5,000 monomer units by, for example, polymerising or oligomerising N-sulphoneazoalkylacrylamide, styrenesulphonic acid, vinylsulphonic acid, allylsulphonic acid, vinyloxybenezenesulphonic acid or 2-allyloxyethanesulphonic acid, possibly with copolymerisation of (meth)acrylic acid or derivatives thereof.

The above-mentioned sulphonic acids can preferably also be used mixed with sulphuric acid for establishing the pH value of the discharge resist print paste. Even alkali metal salts, in particular the sodium or potassium salts, or ammonium salts of the sulphonic acids can be used mixed with strong acids, in particular strong mineral acids, preferably sulphuric acid.

Examples of carboxylic acids suitable for establishing the pH value in the discharge resist print pastes are arene-, alkane-, alkene-, alkyne-, cycloalkane- and cycloalkene-mono-, -di-, -tri- and -poly-carboxylic acids and N-, O- or S-containing five- or six-membered heterocyclic carboxylic acids. Alkanemonocarboxylic acids can have, for example, 1 to 8 C atoms, alkanedicarboxylic acids, for example, 2 to 8 C atoms, alkenemono- or -dicarboxylic acids 3 to 5 C atoms, and alkynecarboxylic acids 3 to 5 C atoms. The carboxylic acids can also be monosubstituted or, independently of one another, polysubstituted, for example trisubstituted, by, for example, alkyl or alkoxy having 1 to 8 C atoms, alkenyl having 3 to 5 C atoms, alkylcarbonyl having a total of up to 8 C atoms, optionally substituted phenylcarbonyl, optionally substituted aminocarbonyl, alkoxycarbonyl having a total of up to 9 C atoms, phenoxycarbonyl, cyano, nitro, fluorine, chlorine, bromine, sulpho, aminosulphonyl, alkylsulphonyl having up to 8 C atoms, optionally substituted phenylsulphonyl, alkylsulphinyl having up to 8 C atoms, optionally substituted phenylsulphinyl, phenyl, hydroxyl or acetamino, or thiocyano.

Examples of suitable carboxylic acids are: oxalic acid, malonic acid, methylmalonic acid, isopropylmalonic acid, dimethylmalonic acid, ethyl-n-propyl-malonic acid, triethylsuccinic acid, tetramethylsuccinic acid, 2,2-dimethylglutaric acid, tetrolic acid, maleic acid, fumaric acid, glutaconic acid, cyclopentane-1,1-dicarboxylic acid, mono-, di- and trichloroacetic acid, mono-, di- and trifluoroacetic acid, bromoacetic acid, cyanoacetic acid, α-cyanopropionic acid, heptafluoro-n-butyric acid, α-fluoroacrylic acid, α-chlorovinylacetic acid, citric acid, 3-chloropropionic acid, 2-bromopropionic acid, 3-bromoacrylic acid, dibromoacetic acid, dichloromalonic acid, anilinediacetic acid, nitriloacetic acid, pyruvic acid, oxaloacetic acid, 2,4-dichlorophenoxyacetic acid, o-, m- and p-cyanophenoxyacetic acid, o-, m- and p-nitrophenoxyacetic acid, 3-nitro-4-chlorophenoxyactic acid, phthalic acid, trimesic acid, pyromellitic acid, o-chlorobenzoic acid, salicylic acid, o-nitrobenzoic acid, 4-nitro-2-methylbenzoic acid, and 2-bromo-6-nitrobenzoic acid.

Examples of phosphonic and phosphinic acids suitable to establish the pH value in the discharge resist print pastes are arenephosphonic and alkanephosphonic acids, arenephosphinic and alkanephosphinic acids, and monoalkyl or monoaryl arene- and alkanephosphonates, which acids, in the aryl or alkyl moiety as the case may be, and which esters, if desired in the acid and/or ester moiety, can be monosubstituted or, independently of one another, polysubstituted, for example up to trisubstituted, for example by alkyl or alkoxy having 1 to 8 C atoms each, alkenyl having 3 to 5 C atoms, alkylcarbonyl having a total of up to 8 C atoms, optionally substituted phenylcarbonyl, optionally substituted aminocarbonyl, alkoxycarbonyl having a total of up to 9 C atoms, phenoxycarbonyl, cyano, nitro, fluorine, chlorine, bromine, hydroxycarbonyl having up to 8 C atoms, aminosulphonyl, alkylsulphonyl having up to 8 C atoms, optionally substituted phenylsulphonyl, alkylsulphinyl having up to 8 C atoms, optionally substituted phenylsulphinyl, phenyl, hydroxyl or acetamino, or thiocyano.

Examples of suitable phosphonic acids are: methaneophosphonic, ethanephosphonic, n-propanephosphonic, isopropanephosphonic, n-butanephosphonic, isobutanephosphonic, tert.-butanephosphonic, neopentanephosphonic and n-hexanephosphonic acid, monochloromethanephosphonic, dichloromethanephosphonic and trichloromethanephosphonic acid, monobromomethanephosphonic acid, hydroxymethanephosphonic, aminomethanephosphonic, 2-aminomethanephosphonic, benzenephosphonic and o-, m- and p-toluenephosphonic acid, o-, m- and p-chlorobenzenephosphonic acid, o-, m- and p-bromobenzenephosphonic acid, phenol-3-phosphonic acid, p-nitrobenzenephosphonic acid, m- or p-methylaminobenzenephosphonic acid, 2-bromo-p-toluenephosphonic acid, 2-, 3- or 4-carboxylbenzenephosphonic acid, p-sulphamoylphosphonic acid, 2-chloro-4-nitrobenzenephosphonic acid, and 2-chloroethanephosphonic acid.

Examples of suitable phosphinic acids are: methanephosphinic, ethanephosphinic, n-propanephosphinic, benzenephosphinic, p-bromobenzenephosphinic, p-methoxybenzenephosphinic p-nitrobenzenephosphinic acid.

Examples of suitable mineral are hypophosphorous acid, phosphorous acid, phosphoric acid, pyrophosphoric acid, nitrous acid, nitric acid, sulphurous acid, sulphuric acid, amidosulphonic acid, hydrochloric acid, hydrobromic acid, and perchloric acid.

Examples of suitable disulphimides, N-acylsulphimides or N-acylamidosulphonates are bis-(4-methylphenylsulphonyl)-imide, bis-methanesulphonylimide, N-methylsulphonyl-4-methylphenylsulphonamide, N-acetyl-naphthalene-2-sulphonamide, N-(2-chloroacetyl)-benzenesulphonamide, and 3,4-dihydro-6-methyl-1,2,3-oxathiazin-4-one.

Examples of organic compounds which, under the conditions of the process according to the invention, split off acids which can be used to establish the pH value are aliphatic compounds which can make available hydrogen chloride, hydrogen bromide or sulphuric acid by 1,2-elimination, aliphatic or aromatic carbonyl halides, in particular chlorides or bromides, and alkanes and alkenes which are disubstituted or trisubstituted by chlorine and/or bromine in 1,1- or 1,1,1-position, the compounds mentioned being advantageously substituted by formyl, acyl, aroyl, hydroxycarbonyl, alkoxycarbonyl, aryloxycarbonyl, cyano, nitro, halogen, alkylsulphonyl, optionally substituted phenylsulphonyl, alkylsulphinyl, optionally substituted phenylsulphinyl, sulpho, phenyl, phosphono, alkylphosphono, arylphosphono or mono-, di- or trialkylsilyl or triphenylsilyl. Further suitable compounds are five- or six-membered heterocyclics which contain 1 to 3 nitrogen atoms and 1 to 3 chlorine atoms in 2-position relative to the nitrogen, as well as monoalkyl phosphates, dialkyl phosphates, alkyl hydrogensulphates, and aryl hydrogensulphates. Examples of the abovementioned compounds are: 3-chloroacetonitrile, 2-chloroethyltriethylsilane, 3-chloroacrylaldehyde, (2-phenylsulphonyl)-ethyl sulphate, 2-chloroethyl sulphate, phenylacetyl chloride, benzoyl chloride, benzoyl bromide, cyanuric bromide or cyanuric chloride, 3,6-dichloropyridazine, benzal bromide, and trichloromethylbenzene.

Examples of inorganic compounds which under thermal action or under hydrolysis conditions split off hydrochloric acid, hydrobromic acid or sulphuric acid are aluminum chloride or bromide, aluminum sulphate, sodium hydrogensulphate, and zinc chloride.

Non-volatile acids, in particular aliphatic or aromatic sulphonic acids, are preferably used to establish the pH value in the discharge resist print pastes. Particularly preferable sulphonic acids are benzenesulphonic or naphthalenesulphonic acids which are optionally monosubstituted or trisubstituted by 1 to 3 alkyl groups having 1 to 3 atoms, cyclohexyl, 1 to 2 chlorine and/or bromine atoms or a nitro group, alkanesulphonic acids having 1 to 4 C atoms and optionally substituted by hydroxyl, chlorine, bromine or alkoxy having 1 to 4 C atoms, or alkanesulphonic acids having 3 to 5 C atoms. Preferable carboxylic acids are dicarboxylic and tricarboxylic acids, such as, for example, oxalic acid and citric acid. Sulphuric acid is the preferred mineral acid. Preferred inorganic compounds are aluminum sulphate, zinc chloride, aluminum chloride and, in particular, sodium hydrogensulphate.

Acids or acid-eliminating compounds used to bring the discharge resist print pastes to a pH value of equal to or less than 3, preferably equal to or less than 2, and very particularly preferably equal to or less than 0.8, act as discharging agents in the process according to the invention. It is of course also possible to use several acids and/or acid-eliminating compounds. A suitable discharge resist print paste is any formulation which enables the abovementioned discharging agents to be applied to the fabric and which, under the application conditions, ensure as level a transfer of print paste as possible to the fabric and produce as sharp a print as possible. To prepare the discharge resist print pastes to be used according to the invention, the above-mentioned acids and/or acid-eliminating compounds are added in such amounts to customarily used print pastes, provided the print paste constituents are sufficiently acid-resistant, that the discharge resist print pastes have a pH value of $\leqq 3$, preferably $\leqq 2$ and very particularly preferably of $\leqq 0.8$. The discharging agents are preferably added as early as the stage at which the print pastes are prepared from the starting constituents. To obtain the pH values specified, the acids must have correspondingly low pKa values and be added in correspondingly large amounts. As a rule, concentrations are required of the discharging agent in the discharge resist print pastes of 5 to 250 g/kg, preferably 20 to 130 g/kg, in order to establish the pH value specified and in order to ensure that in view of the amounts of discharge resist print paste customarily used the amount of discharging agent required for the discharge is present on the substrate to be printed. This amount depends on the depth of dyeing, on the dischargeability of the dyestuffs used, and on the activity of the discharging agent. As a rule, the discharging agent is used in a molar ratio of discharging agent to discharging dyestuffs of 1:(1 to 10,000) at the customary amounts of discharge print paste applied and at the concentrations specified.

As customary, the discharge resist print pastes contain not only the discharging agents but also water, thickeners and auxiliaries (for example swelling agents, dispersants or carriers) and, if appropriate, non-dischargeable dyestuffs. Examples of thickeners suitable for discharge rest print pastes to be used according to the invention are: starch degradation products, such as dextrin, nonionic starch derivatives, such as British Gum, types of gum, such as gum arabic, locust bean flour, in particular locust bean flour ether or tragacanth, and guar derivatives, in particular guar ether or cellulose ether carboxylic acids. Further, the discharge resist print pastes can also contain customary auxiliaries and additives, such as, for example, hydrotropic substances, and additives which promote wetting, penetration and dyestuff absorption. The discharging step is particularly favoured by the presence of nonionic detergents or solubilisers which are advantageously present in the discharge resist print pastes, such as, for example, glycerol and/or polyglycols, such as polyethylene glycol, having a mean molecular weight of 300 to 500, and/or polypropylene glycols, as described, for example, in German Offenlegungsschrift No. 2,951,312, or products based on N,N-dialkyl-substituted lower carboxamides, such as, for example, N,N-dicyanoethylformamide. To obtain coloured designs disperse dyestuffs which are resistant to the discharging agent can also be incorporated into the discharge resist print pastes. The discharge resist print pastes used according to the invention do not contain any reducing or oxidising agents.

By means of the process according to the invention, it is possible to discharge any disperse dyestuff whose chromophor is destroyed by the acid-reacting discharge resist print pastes having a pH value $\leqq 3$, preferably $\leqq 2$ and very particularly preferably $\leqq 0.8$ and/or which are converted by these discharge resist print pastes into a form which no longer exhausts onto the hydrophobic fibres. Examples of dyestuffs which can be discharged in the process according to the invention are azo dyestuffs which are wholly or predominantly in the azo form, naphthalimide dyestuffs, and certain anthraquinone dyestuffs.

Examples of monoazo dyestuffs which can be discharged in the process according to the invention are those which have carbocyclic or heterocyclic diazo and/or coupling components from among anilines, naphthylamines, phenols, naphthols, 5- or 6-membered heterocyclics which can be optionally benzo-fused. Examples of suitable disazo dyestuffs are those whose central component is derived from anilines, naphthylamines or 5- or 6-membered ring-heterocyclic amines. Examples of dischargeable azo dyestuffs are: C.I. Disperse Yellow 7, 23 and 68; Disperse Orange 1, 3, 5, 13, 18, 19, 20, 21, 25, 29, 30, 33, 38, 44, 55, 61, 66, 71, 81, 96, 127, 128 and 130; C.I. Disperse Red 1, 2, 5, 7, 13, 17, 43, 50, 54, 56, 65, 73, 76, 82, 90, 134, 151, 160, 167, 168, 177, 180, 183, 184, 202, 203, 279, 281, 311, 312 and 324; C.I. Disperse Violet 12, 13, 24, 48, 58, 63 and 33; C.I. Disperse Blue 79, 85, 94, 122, 125, 130, 139, 148, 149, 165, 165/1, 165/2, 171, 183, 284, 287, 290, 295 and 330; C.I. Disperse Brown 1, 4/1 and 19; C.I. Disperse Green 9.

The dyestuffs of the formula

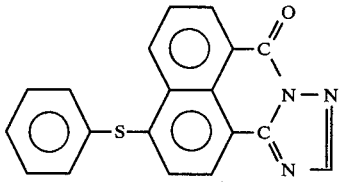

is mentioned as an example of naphthylamide dyestuffs which can be discharged in the process according to the invention.

Examples of anthraquinone dyestuffs which can be discharged in the process according to the invention are those which have one or more carboxylate groups, such as, for example, the dyestuff C.I. Disperse Blue 288.

Azo dyestuffs which are wholly or predominantly in the azo form are preferably used as dischargeable dyestuffs in the process according to the invention.

The process according to the invention is suitable for textile materials which consist of hydrophobic fibres, for example polypropylene, polyacrylonitrile, polyamide or cellulose triacetate, but in particular of polyester fibres. Examples of suitable polyester fibres are those based on polybutylene terephthalate, poly-1,4-cyclohexylene dimethylene terephthalate, but in particular polyethylene terephthalate, which polyesters can have been modified, for example with the view to easier dyeability, for example by cocondensing other components, for example other dicarboxylic acids and/or other diols. The process according to the invention is however also suitable for those textile materials which predominantly contain hydrophobic fibres in addition to other fibres, such as, for example, viscose staple or cotton. Of such textile materials in particular those are suitable which on dyeing or printing with disperse dyestuffs nevertheless give a visually uniform product. The textile material can be, for example, in the form of random webs, felts, carpets, woven or weft- or warp-knit fabric webs, or pieces.

The process according to the invention is carried out by applying the disperse dyestuffs dischargeable to white to the textile material in the form of dyeing liquors or print pastes. In the case where a dyeing liquor is used, the textile material is, for example, impregnated in a way which is in itself known, for example it is slop- or nip-padded. These dyeing liquors or print pastes can contain one or more of the disperse dyestuffs which are dischargeable to white and have been mentioned, in addition to known customary dyeing or printing auxiliaries, such as, for example, dispersants, wetting agents, anti-foams and padding auxiliaries. The impregnated textile material is squeezed to give a liquor pick-up of 50 to 120%. The textile materials thus treated are then carefully dried in such a way that no dyestuff becomes fixed in the fibre. This drying can be effected, for example, by means of warm air, possibly combined with preceding infrared irradiation, the temperature being about 60° to 800° C., at most about 100° C. with corresponding curtailment of the time. The textile materials thus prepared are then printed with one of the abovementioned discharge resist print pastes in a desired pattern. The impregnated and printed textile materials are then subjected to a heat treatment at between 100° to 230° C. In the lower temperature range, up to about 130° C., the heat is preferably supplied by saturated steam. In the case of heat treatments which are carried out between 160° and 230° C. the heat carrier used is preferably superheated steam or hot air. If steam is used for the heat treatment, the heat treatment is preceded by a drying stage at 60° C. to at most 100° C., for example by means of warm air possibly combined with preceding infrared irradiation. Some discharging agents, of the type which form an acid-reacting compound only on heat treatment, require the presence of small amounts of water during the heat treatment. Examples of such discharging agents are inorganic discharging agents, such as, for example, aluminum chloride, aluminum sulphate, or zinc chloride. In the case of such discharging agents the heat treatment is preferably carried out by means of superheated steam, preferably at 170° to 200° C. After the heat treatment, the result of which is that the disperse dyestuffs are fixed in areas not afterprinted with discharge resist print paste and that the disperse dyestuffs are destroyed in areas printed with the discharge resist print paste, the textile materials are aftertreated in a conventional manner, rinsed hot and cold, and dried.

In a particular embodiment of the process according to the invention, the dyeing liquor, in addition to disperse dyestuffs which are dischargeable to white, also contains one or more disperse dyestuffs which are acid-resistant and hence are not destroyed by the acid-reacting discharge resist print pastes to be used according to the invention. If, in other respects, the procedure given above is followed, multicoloured designs are obtained.

As already mentioned, the disperse dyestuffs which are dischargeable to white can also be printed onto the textile material in the form of print pastes, and then be afterprinted with the discharge resist print paste in the desired pattern. This method of working does not necessarily require incipient or intermediate drying between the two printing steps, so that it is also possible to work wet-on-wet. The textile prints are then fixed and finished as already described above. In the case of this method too it is possible to add to the dyestuff print paste which is printed on first and which can also contain several disperse dyestuffs which are dischargeable to white and of the type mentioned one or more disperse dyestuffs which are resistant to acid and hence to discharging agent. In this case also, multicoloured designs are obtained. In another version of carrying out the process according to the invention, the ground which is impregnated or printed with disperse dyestuffs which are dischargeable to white is printed with discharge resist print pastes of the type mentioned which in turn contain one or more acid-resist print disperse dyestuffs. When the textile materials are then fixed and finished as described above, multicoloured designs are also obtained in this case.

Finally, it is also possible first to print the textile material, in the pattern desired, with a discharge resist print paste which contains one or more discharging agents of the type mentioned, and then to afterprint the textile material thus printed either after incipient or intermediate drying or without incipient or intermediate drying, namely "wet-on-wet" with a print paste which contains one or more dyestuffs which are dischargeable to white. The textile material thus treated is subjected to the abovementioned heat treatment, to fix the dyestuff in the areas not covered with discharge resist print paste and to destroy the dyestuff in the areas covered with discharge resist print paste, and finished as already mentioned above. This method gives multicoloured patterns when the discharge resist print paste also contains one or more non-dischargeable disperse dyestuffs and/or the print paste, in addition to one or more disperse dyestuffs which are dischargeable to white, also contains one or more disperse dyestuffs which are resistant to acid and hence to discharging agent.

The dyestuffs are present in the padding liquors, print pastes or discharge resist print pastes in highly disperse form, as customary and known for disperse dyestuffs. The padding liquors or print pastes which are to be used according to the invention are prepared in a manner which is in itself known by mixing the liquor or print paste constituents with the amount of water necessary and with liquid highly disperse or solid redispersible formulations of the dyestuffs.

Examples of disperse dyestuffs which are resistant to acid and hence, in the process according to the invention, resistant to discharging agent and which, to prepare multicoloured designs, can be combined with dischargeable dyestuffs are anthraquinone, naphthalimide, nitro, quinaphthalone or methine dyestuffs or dyestuffs which have been prepared by azo-coupling and which are predominantly in the hydrazone form, such as, for example, azo dyestuffs having 2-hydroxypyrid-6-one derivatives as coupling components. Examples of suitable dyestuffs which are resistant to discharging agent are C.I. Disperse Yellow 63, 114, 180, 54 and 58; C.I. Disperse Orange 146 and 139; C.I. Disperse red 60, 91, 92 and 132; C.I. Vat Red 41; C.I. Disperse violet 35; and C.I. Disperse Blue 56 and 87.

In the preparation of white discharges it is also possible to add to the acidic discharge resist print pastes used according to the invention acid-resistant optical brighteners.

In the examples which follow parts by weight relate to parts by volume as the kilogram relates to the liter.

EXAMPLE 1

A polyester fabric is padded at 20° to 30° C. with a pick-up of 70% with a liquor of 100 parts by weight of the liquid commercial form of C.I. Disperse Blue 290, 3 parts by weight of citric acid, 20 parts by weight of a polyacrylamide-based antimigration agent and 877 parts by weight of water, and carefully dried at 80° to 100° C. The fabric is then afterprinted in a pattern with a discharge resist print paste which contains, per 1,000 parts by weight, 50 parts by weight of the liquid commercial form of C.I. Disperse Yellow 114, 375 parts by weight of a 14% strength starch ether thickening, 125 parts by weight of a 5% strength locust bean flour ether thickening, 80 parts by weight of glycerol, 80parts by weight of polyglycol 400 and 100 parts by weight of p-toluenesulphonic-acid and has a pH value of 0.6. Fixing by means of superheated steam at 175° C. for 7 minutes, reduction clearing, soaping, and subsequent rinsing and drying produce a crisp and colouristically very fast discharge on navy blue ground.

EXAMPLE 2

If a polyester fabric is padded with a liquor which contains as dyestuff per 1,000 parts by volume 20 parts by weight of the liquid commercial form of C.I. Disperse Brown 1, is dried and afterprinted with the discharge resist print paste of Example 1 but without a non-dischargeable dyestuff, all steps being carried out as described in Example 1, and is thermosoled at 200° C. for 30 seconds, the result, after the aftertreatment of Example 1, is a crisp and colouristically very fast white discharge on brown ground.

EXAMPLE 3

A cellulose triacetate fabric is padded with a liquor which contains as dyestuff per 1,000 parts by volume 30 parts by weight of the liquid commercial form of C.I. Disperse Orange 71 and carefully dried, both steps being carried out as described in Example 1. The fabric is then afterprinted with a discharge resist print paste which contains per 1,000 parts by weight 500 parts by weight of a 5% strength acid-resistant thickening based on locust bean flour ether, 80 parts by weight of glycerol, 80 parts by weight of polyglycol 400 and 50 parts by weight of methanesulphonic acid and has a pH value of 0.3, and is dried. The fabric is fixed with superheated steam at 175° C. for 7 minutes, and the print is then rinsed, neutralised, soaped and dried. The printed areas appear white on orange ground.

EXAMPLE 4

A polyester fabric is padded with a liquor which contains per 1,000 parts by weight 150 parts by weight of the liquid commercial form of a dyestuff which consists to about 70% of C.I. Disperse Blue 333 and to about 30% of C.I. Disperse Orange 29, and is dried, both steps being carried out as described in Example 1. The fabric is then afterprinted with a discharge resist print paste which is as in Example 1 but in which p-toluenesulphonic acid has been replaced by an alkylnaphthalenesulphonic acid which contains about 15% of sulphuric acid and about 15% of water and which paste has a pH value of 0.6, printed, fixed and aftertreated, all steps being carried out as in Example 1. The printed areas are white with sharp contours on black ground.

EXAMPLE 5

A polyester fabric is padded with a liquor which contains 80 parts by weight of the liquid commercial form of C.I. Disperse Blue 96, is dried, and is printed with a discharge resist print paste which contains per 1,000 parts by weight 500 parts by weight of a 5% strength locust bean flour ether thickening, 80 parts by weight of polyglycol 400, 80 parts by weight of glycerol and 100 parts by weight of anhydrous zinc chloride, the three steps being carried out as described in Example 1. The fabric is dried, steamed at 175° C. for 7 minutes, subsequently reduction-cleared at 80° C. for 15 minutes using 2 parts by weight of hydrosulphite and 3 parts by volume of a 50% strength sodium hydroxide solution, rinsed, soaped and dried. This gives a white pattern on a navy blue background.

EXAMPLE 6

A polyester fabric is padded at 20° to 30° C., with a pickup of 70% with a liquor of 20 parts by weight of the liquid commercial form of C.I. Disperse Orange 71, 3 parts by weight of citric acid, 20 parts by weight of a polyacrylamide-based antimigration agent and 957 parts by weight of water, and is carefully dried at 80° to 100° C. The fabric is then afterprinted in a pattern with a discharge resist print paste which contains per 1,000 parts by weight 500 parts by weight of a 5% strength locust bean flour ether thickening, 80 parts by weight of glycerol, 80 parts by weight of polyglycol 400 and 50 parts by weight of sulphuric acid and has a pH value of 0.3. A white discharge is obtained on orange ground after a hot air fixing at 200° C. for 1 minute, reduction clearing and rinsing, soaping and drying steps.

EXAMPLE 7

Example 1 is repeated, except that only 70 parts by weight of the liquid commercial form of C.I. Disperse Blue 290 are used in place of 100 parts by weight, 60 parts by weight of C.I. Disperse Blue 56 are used in place of C.I. Disperse Yellow 114 and 80 parts by weight of N,N-dicyanoethylforamide are used in place of polyglycol 400, affording a clear blue discharge on navy blue ground.

EXAMPLE 8

A polyester fabric is padded with a liquor which contains 20 parts by weight of the liquid commercial form of C.I. Disperse Yellow 68, is dried, and printed with a discharge resist print paste which contains per 1,000 parts by weight 500 parts by weight of a 5% strength locust bean flour ether thickening, 80 parts by weight of polyglycol 400, 80 parts by weight of glycerol, 2 parts by weight of a padding auxiliary based on a fatty acid polyglycol ester and 100 parts by weight of oxalic acid and has a pH value of 0.7, the three steps being carried out as described in Example 1. The fabric is dried, steamed with superheated steam at 175° C. for 7 minutes, then rinsed, reduction-cleared, rinsed, soaped at the boil, and dried. The printed areas appear white on yellow ground.

EXAMPLE 9

A polyester fabric is screen-printed with a discharge resist print paste which has a pH value of 0.6 and which consists of 500 parts by weight of a 5% strength locust bean flour thickening, 80 parts by weight of glycerol, 80 parts by weight of polyglycol 400, 100 parts by weight of p-toluenesulphonic acid, 20 parts by weight of a padding auxiliary based on a fatty acid polyglycol ester and 220 parts by weight of water. The fabric is then afterprinted without intermediate drying, that is "wet-on-wet," with a print paste which contains per 1,000 parts by weight 80 parts by weight of C.I. Disperse Blue 290, 300 parts by weight of a low-viscosity alginate thickening (10% strength), 200 parts by weight of a starch ether (10% strength), 5 parts by weight of a polyphosphate-based deliming agent, and 3 parts by weight of citric acid. The fabric is dried, steamed at 175° C. for 7 minutes, then reduction-cleared at 80° C. for 15 minutes using 2 parts by weight of hydrosulphite and 3 parts by volume of a 50% strength sodium hydroxide solution, rinsed, soaped, and dried. A white pattern is obtained on navy ground.

What we claim is:

1. In the process for preparing discharge prints on textile materials containing hydrophobic fibers wherein at least one disperse dyestuff dischargeable to white is applied to the textile material in the form of a dyeing liquor or print paste and is also contacted by a pattern-applied discharge resist print paste, and then the material is heat treated at 100° to 230° C., the improvement comprises said discharge resist print paste having under the heat treatment conditions a pH value of zero to 3.

2. The process according to claim 1 wherein discharge resist print paste has a pH value of zero to 2 under heat treatment conditions.

3. The process according to claim 1 wherein the discharge resist print paste has a pH value of zero to 0.8 under heat treatment conditions.

4. The process according to claim 1 wherein the discharge resist print paste has a pH value of zero to 3 at room temperature.

5. The process according to claim 1 wherein the discharge resist print paste contains a sulphonic acid.

6. The process according to claim 1 wherein the discharge resist print paste contains sodium hydrogensulphate.

7. The process according to claim 1 wherein the discharge resist print paste contains zinc chloride, aluminium sulphate or aluminium chloride.

8. The process according to claim 5 wherein the discharge resist print paste contains zinc chloride, aluminium sulphate or aluminium chloride.

9. The process according to claim 6 wherein the discharge resist print paste contains zinc chloride, aluminium sulphate or aluminium chloride.

10. The process according to claim 1 wherein the discharge resist print paste contains sulphuric acid.

11. The process according to claim 1 wherein the disperse dyestuff dischargeable to white is first applied to the textile material and then the discharge resist paste is applied in a preselected pattern.

12. The process according to claim 1 wherein the discharge resist paste is first applied to the textile material in a preselected pattern and then the disperse dyestuff dischargeable to white is applied.

13. The process according to claim 1 wherein a non-dischargeable disperse dyestuff is also printed on the textile material in the form of a print paste.

14. The process according to claim 1 wherein a non-dischargeable disperse dyestuff is also applied to the textile material in the form of dyeing liquor and the treated material is dried at least incipiently prior to the heat treatment step.

15. The process according to claim 1 wherein the discharge resist print paste additionally contains a nonionic detergent or solubilizer.

16. The process according to claim 15 wherein the nonionic detergent or solubilizer is selected from the group of glycerol, polyethylene glycol having a mean molecular weight of 300 to 500, polypropylene glycol N,N-dialkyl-substituted lower carboxamides having 1 to 5 carbon atoms in each alkyl and 1–4 carbon atoms in each carboxamide moiety.

* * * * *